US006364163B1

(12) United States Patent
Mueller

(10) Patent No.: US 6,364,163 B1
(45) Date of Patent: Apr. 2, 2002

(54) REFILLABLE DISPENSER AND CARTRIDGE

(76) Inventor: John J. Mueller, 11208 Franks Rd., Chagrin Falls, OH (US) 44023

( * ) Notice: Subject to any disclaimer, the term of this patent is extended or adjusted under 35 U.S.C. 154(b) by 0 days.

(21) Appl. No.: 09/441,477

(22) Filed: Nov. 17, 1999

Related U.S. Application Data

(60) Provisional application No. 60/108,941, filed on Nov. 18, 1998.

(51) Int. Cl.[7] ..... B67D 5/00

(52) U.S. Cl. ..... 222/83; 222/95; 222/105; 222/212; 222/372; 222/386.5; 222/481.5

(58) Field of Search ..... 222/81, 83, 95, 222/105, 212, 327, 386, 386.5, 481.5

(56) References Cited

U.S. PATENT DOCUMENTS 3,319,837 A * 5/1967 Mueller ..... 222/212
3,656,660 A * 4/1972 Mueller ..... 222/94
3,847,307 A * 11/1974 Hosek ..... 222/386.5
4,239,132 A * 12/1980 Mueller et al. ..... 222/212
4,760,937 A * 8/1988 Evezich ..... 222/95
5,501,368 A * 3/1996 Brandhorst et al. ..... 222/95
5,687,882 A * 11/1997 Mueller ..... 222/212
5,915,594 A * 6/1999 Nakata ..... 222/81
6,062,430 A * 5/2000 Fuchs ..... 222/386.5

* cited by examiner

*Primary Examiner*—Joseph A. Kaufman
(74) *Attorney, Agent, or Firm*—Watts Hoffmann Fisher & Heinke

(57) ABSTRACT

A refillable dispenser of fluid material includes a flexible container having a fluid dispensing portion and a displacement fluid receiving portion spaced from the fluid dispensing portion. A cap is removably fastened to the container for closing an opening at the displacement fluid receiving portion. A cartridge is disposed in the container and contains fluid material to be dispensed. The cartridge includes an expansible bladder and may include a collar member connected to the bladder. A support post may be supported in the container and received by the collar member. A first flow restrictor allow flow of displacment fluid only from outside the container into an interior of the bladder. A second flow restrictor allows flow of material only from within an interior portion of the container external to the bladder to outside the container. Another feature is a cartridge for refilling a dispenser of fluid material.

32 Claims, 7 Drawing Sheets

REFILLABLE DISPENSER AND CARTRIDGE

This Application claims Benefit of Provisional Application Ser. No. 60/108,941 filed Nov. 18, 1998.

BACKGROUND OF THE INVENTION

1. Field of the Invention

This invention relates to dispensers, and more particularly to flexible dispensers that permit dispensing of material through deformation and displacing the dispensed material with fluid that enters an expansible bladder within the dispenser.

2. Prior Art

A dispenser is disclosed in U.S. Pat. No. 3,319,837 to Mueller, issued May 16, 1967, entitled "Dispensing Device." A bladder within a flexible container receives displacement fluid such as air that flows into the bladder after contents of the container have been dispensed by squeezing the container and then allowing the container to return to its original volume. The container employs one way valves to assure that displacement fluid only enters the bladder, in effect maintaining the contents adjacent the container so that the container is always "full" until empty. A disadvantage of this dispenser is that the manner in which the bladder expands is not controlled, resulting in possible trapping of the contents remote from the outlet, which is then difficult to dispense. Another dispenser is disclosed in U.S. Pat. No. 4,239,132 to Mueller et al., issued Dec. 16, 1980, and entitled "Apparatus For Facilitating Inflow Through Closure Threads of Dispenser." That dispenser includes a tube in a flexible container and through which displacement fluid such as air flows to inflate the bladder and displace material dispensed from the container. That construction provides some, but only limited control of bladder expansion.

SUMMARY OF THE INVENTION

The present invention is directed to a flexible and resilient container, a support post preferably supported in the container, a cartridge disposed in the container and containing fluid material to be dispensed, the cartridge including an expansible bladder preferably connected to a collar member, the collar member being slidably disposed on the post, a first flow restrictor for allowing flow of air only from outside the container into an interior of the bladder, and a second flow restrictor for allowing flow of material only from within an interior portion of the container external to the bladder to outside the container.

More specifically, the collar member is connected to the bladder and is adapted for movement toward a fluid dispensing end portion of the container. The bladder sealingly surrounds the first flow restrictor. An end cap is fastened to the container for closing off an opening at a displacement fluid receiving end portion of the container. In a preferred aspect of the invention, the cartridge includes a piston which is connected to or formed integrally with the collar member. The piston is preferably formed of a flexible material and is adapted for movement in the container.

The cartridge is sealed at a fluid dispensing end portion to prevent the material that is filled into the cartridge from leaking out during shipping and handling. The cartridge is preferably cylindrical shaped. A "lower" section of the cartridge is folded into an "upper" section or body portion of the cartridge. The collar and the lower section of the cartridge (e.g., the bladder) are disposed in the upper section such that when the cartridge is filled with the material to be dispensed, the collar is located adjacent the bottom of the upper section and the bladder preferably forms a loop that extends from the collar member substantially halfway along the side wall of the upper section. It will be appreciated by one skilled in the art that relational terms such as "upper" and "lower" are used for improving understanding of the invention and should not be construed as necessary limitations thereof. The upper and lower sections of the cartridge may be formed of material having the same flexibility or thickness. Alternatively, to improve handling of the cartridge, the upper section of the cartridge may be formed of a less flexible or thicker material than the lower section of the cartridge.

The end cap is removably fastened to the container to provide an air tight seal of the cartridge in the container. The end cap is fastened, such as by threads, to the displacement fluid receiving end portion of the container. The first flow restrictor that allows only displacement fluid to enter the container and act upon the interior of the bladder, is preferably disposed in the end cap. The end cap may include a recess for receiving the post. A cutting element for breaking the seal of the cartridge may be supported in the container. A stop member that prevents axial movement of the support post, may also be supported in the container.

The first flow restrictor includes a first passageway through the container, preferably through the end cap, that communicates with the interior of the bladder, and a first check valve that cooperates with the first passageway. The structure of the second flow restrictor may be adapted to suit the viscosity of the fluid material to be dispensed from the container. When the fluid to be dispensed is sufficiently viscous, the second flow restrictor may be merely a dispensing passageway through the container that communicates with an interior portion of the container external to the bladder. In that case, the viscous material itself inhibits foreign material, including displacement fluid, from undesirably entering the container through the second passageway. On the other hand, when a less viscous material is to be dispensed from the container, the second flow restrictor preferably includes a second check valve cooperating with the second passageway to inhibit foreign material from undesirably entering the container through the second passageway.

A preferred embodiment of the invention is directed to a cartridge for refilling the fluid dispenser. The cartridge includes a body portion and the expansible bladder extending therefrom. The collar member is connected to the bladder. The support post may be supported by the cartridge before it is loaded into the container. Alternatively, the post may be supported in the container rather than in the cartridge, or inserted into the bottom of the sealed cartridge, in which cases in addition to the seal at the fluid discharge end of the cartridge a seal may be disposed over an aperture in the collar member that receives the support post.

When it is desired to dispense material, the container and, in turn, the cartridge are flexed along their side walls. Internal pressure within the container forces the material through the second flow restrictor and out of the container through the second passageway. When flexing pressure on the container is removed, the side walls of the container and cartridge return to their original shape. The second check valve prevents displacement fluid such as air from entering the container through the dispensing passageway and ambient pressure outside the container overcomes the bias of the first check valve and ambient fluid (e.g., air) enters the bladder. Frictional forces between, for example, the piston and the post, resist the movement of the piston along the post. Displacement fluid that has entered the bladder then flows past the piston into the loop of the bladder, and initially inflates the loop of the bladder and urges it toward the second passageway, maintaining the loop above the piston. The forces of the displacement fluid active within the bladder and on the piston continually maintain the piston adjacent the material to be dispensed.

With the above arrangements, the loop of the bladder, being positioned above the piston as the bladder expands, avoids random expansion and entanglement of the bladder and formation of pockets of material in the container, trapped alongside by the bladder, rather than displaced toward the dispensing passageway. Movement of the piston toward the second passageway neatly controls the bladder expansion and decreases the size of the loop as the material in the container is depleted. This assures not only that the dispenser is in effect always "full," regardless of the orientation of the container, but also that essentially the entire contents can be effectively dispensed.

The container thus is divided into two sections—a section of fluid material to be dispensed and a section of displacement air or other fluid. The respective volumes of these two sections vary inversely as the cartridge, which is originally full of the material to be dispensed, is emptied through use.

The dispenser of the invention offers numerous advantages. The cartridge enables the dispenser to be conveniently and efficiently refilled. To refill the dispenser, the end cap is removed and the spent cartridge is moved out of the container. The refill cartridge is inserted into the container with or without its seal being broken. The seal at the dispensing end of the refill cartridge is broken at some point in a manner effective to enable discharge of the contents. The post, which may be carried by the cartridge, supported in the container, or inserted from the bottom of the sealed container, is positioned inside the container and/or inside the cartridge. The end cap is fastened to the displacement fluid end portion of the container, thereby completing the refill procedure.

Another advantage is that the design of the dispenser facilitates commercial use such as in applications where frequent refilling is necessary as in applying caulk or glue in carpentry, as well as with automation equipment in which the container may be kept in a fixed position by a support member and only the cartridge is moved during refilling. In addition to the advantageous refillable design of the invention, the dispenser prevents exposure of the fluid material from air or other fluid outside the container. The dispenser also enables an even or generally constant discharge of material, and is also usable with conventional metering devices and applicators. The dispenser may be utilized in various orientations, even so as to discharge fluid material vertically upward. The dispenser is able to efficiently discharge fluid material of a variety of viscosities from thick to watery. Examples of fluid materials that may be dispensed in accordance with the present invention include paints, caulks, soaps, and fluids utilized in the semiconductor industry, to name a few.

Other embodiments of the dispenser of the invention are contemplated to provide particular features and structural variants of the basic elements. The specific embodiments referred to as well as possible variations and the various features and advantages of the invention will become better understood from the detailed description that follows, when considered in connection with the accompanying drawings.

DETAILED DESCRIPTION OF PREFERRED EMBODIMENTS

Figure 1:
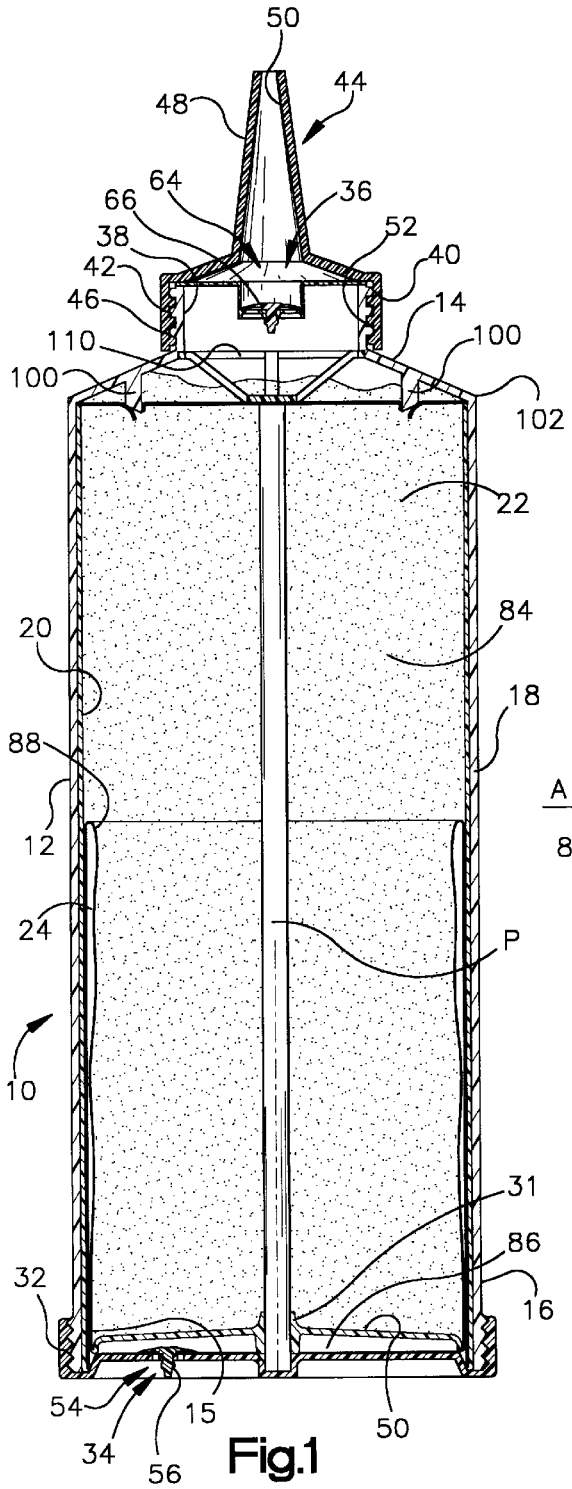
FIG. 1 is a longitudinal sectional view of a dispenser of the invention, showing a piston at the bottom of a substantially full container.

With reference to the drawings, a dispenser 10 is shown in FIG. 1, which includes a flexible and resilient container 12 made of plastic or the like having a fluid dispensing end portion 14 and a displacement fluid receiving end portion 16 with a side wall 18 extending therebetween. A cartridge 20 disposed in the container contains fluid material 22 to be dispensed. The cartridge includes an expansible bladder 24 having a first end portion 26 (FIG. 4) disposed near the displacement fluid receiving end portion and a second end portion 28 spaced apart from the first end portion. A piston 30 having a collar 31 is connected to the first end portion of the bladder and is adapted for movement on a support post or rod P inside the container toward the dispensing end portion 14. An end cap 32 is fastened to the container for closing or sealing off an opening 15 at the displacement fluid receiving end portion of the container. A first flow restrictor 34 allows flow of air only from outside the container into the interior of the bladder. A second flow restrictor 36 allows flow of material only from within an interior portion of the cartridge external to the bladder to outside the container. The bladder 24 sealingly surrounds the first flow restrictor 34.

For a discussion of other features of the container that may be suitable for use in the present invention, such as but not limited to ways to support the post in the fluid discharge portion of the container and to inlet displacement fluid from the fluid discharge portion of the container through a tubular post, refer to U.S. Pat. No. 5,687,882 which is incorporated herein by reference in its entirety.

An opening 38 is provided at the dispensing end 14 of the container. At the dispensing end and surrounding the opening 38, the container has a neck portion 40 that is exteriorly threaded at 42. A cap 44 has a downwardly extending skirt 46, and an upper tapered portion 48 extending therefrom to a cap opening 50. The skirt of the cap is interiorly threaded at 52, which threads correspond to the exterior threads 42, for securing the cap to the container.

The first flow restrictor 34 includes a first passageway 54 through the end cap of the container, which communicates with the interior of the bladder, and a first check valve 56 cooperating with the first passageway 54. The first passageway 54, best shown in the U.S. Pat. No. 5,687,882 patent, includes, for example, four holes 58 (only two of which are shown in FIG. 3) spaced around a valve opening 60. This particular umbrella-type check valve is only one of many known check valve types that can satisfactorily be used. Advantageously, the check valves are made of rubber. However, any suitable material may be used for the check valves, and such material may be selected for its desired response to fluids. In other words, the check valves may use material of various resiliency. As shown in FIG. 3, the check valve 56 is secured within the valve opening 60 by a protuberance 62. The first check valve 56 normally closes the holes 58 of the first passageway 54, and its open position is shown by dotted lines in FIG. 2. To enable the first check valve 56 to be opened manually for enabling the displacement fluid inside the bladder to escape, the check valve 56 may be formed with a finger that protrudes through one of the holes 58. One may push up on the finger to open the valve 56.

The structure of the second flow restrictor 36 is adapted to suit the viscosity of the fluid material to be dispensed from the container. When the fluid is viscous, the second flow restrictor may consist only of a second passageway 64 that communicates with an interior portion of the container external to the bladder 24. In this case, the viscous material itself acts as a valve to inhibit foreign material including displacement fluid from undesirably entering the container through the second passageway.

As best shown in FIG. 3, especially when a less viscous material 22 is to be dispensed, the second flow restrictor 36 also includes a second check valve 66. In a preferred construction, the second flow restrictor 36 includes a valve seat body 68 having a lip portion 70 extending around a cup portion 72 having a side wall 74 and a valve seat 76. The valve seat includes a hub portion 78 having a valve opening 80. Support spokes branch out from the hub portion 78 and define the second passageway 64, shown here as including, for example, four openings 82 (only two of which are shown in FIG. 3), the spokes and openings being fully illustrated in the U.S. Pat. No. 5,687,882 patent. The second check valve 66 is received by the valve opening 80 and normally closes the openings 82 of the second passageway 64.

Figure 2:
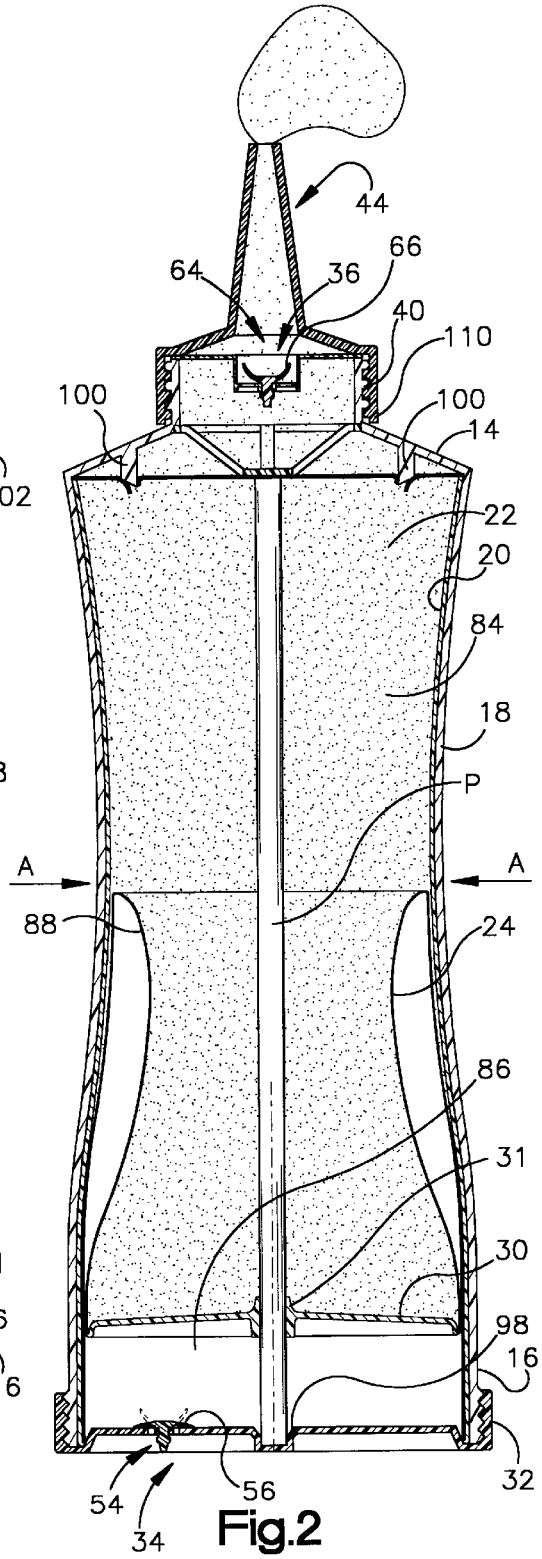
FIG. 2 is a longitudinal sectional view of the dispenser of FIG. 1, showing the piston moved toward a dispensing end of a container.
Figure 3:
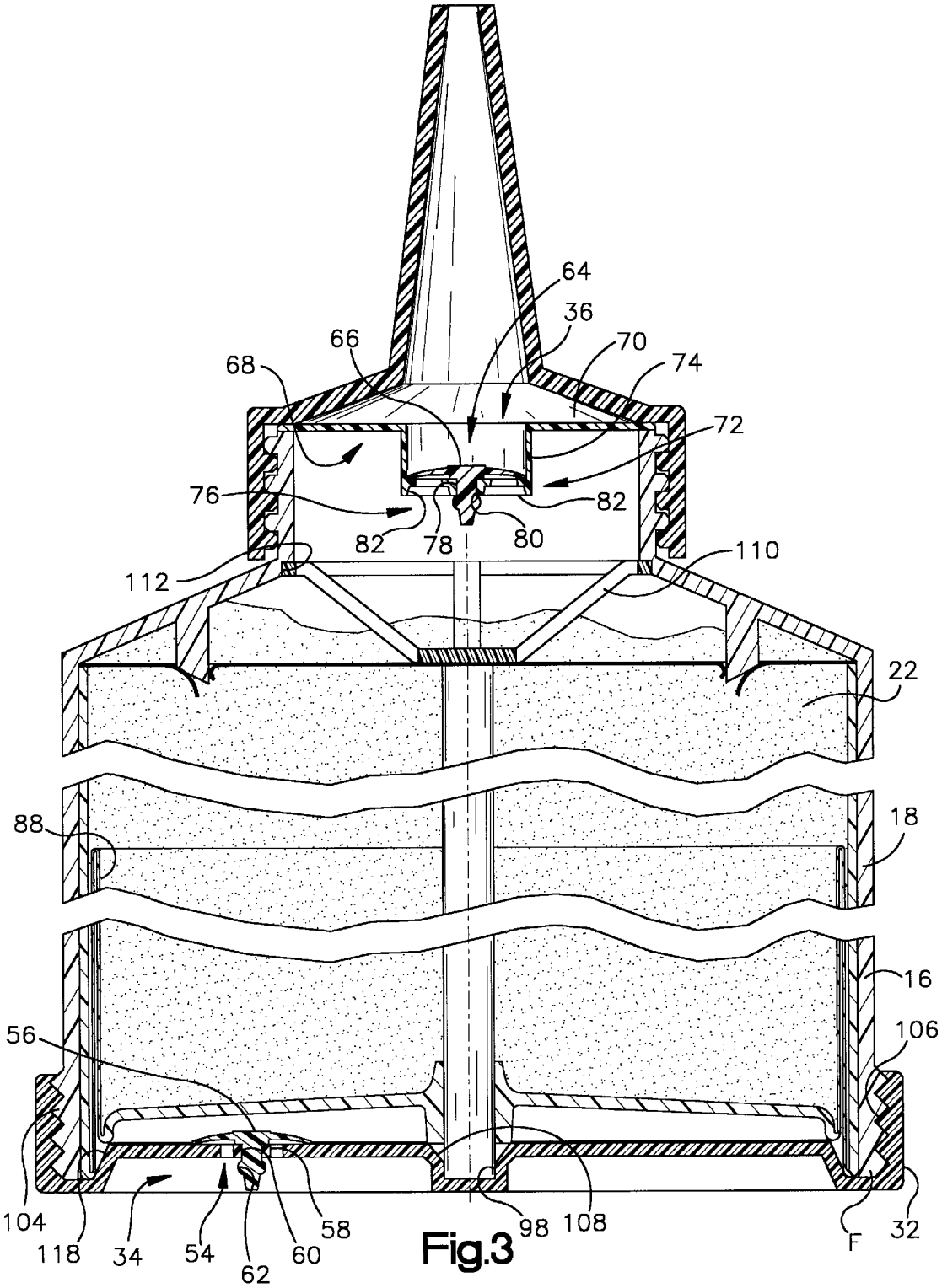
FIG. 3 is an enlarged sectional view of the dispenser shown in FIG. 1.

As shown in FIGS. 1 and 2, the piston 30 and the bladder 24 divide the container into substantially two sections, a dispensing material section 84, and a displacing fluid section 86. Although in FIGS. 1 and 2 the piston 30 is shown with the collar 31 on the support post P, the dispenser 10 may be formed without the support post P, and the piston 30 may be formed without the collar 31. Preferably, the bladder 24 has a size and shape to fill the container when it is fully inflated. The piston 30 may be flexible or rigid depending on the application, and is preferably formed of plastic or the like. If the piston 30 is flexible, it will deform a certain extent to conform to the contour of the side wall 18 when the container is flexed and in that case the container can be squeezed anywhere along its length including on the portion surrounding and contacting the piston 30. The cartridge and the container side wall are formed of flexible material.

Advantageously, the bladder is arranged to extend above the piston so as to form a loop 88 when the cartridge contains the fluid material 22. The loop advantageously initially extends substantially halfway up the cartridge above the piston 30, as shown in FIG. 1. The loop may initially decrease in length when the piston is first moved upward along the support post due to filling of the bladder with the displacement fluid. However, as shown in the U.S. Pat. No. 5,687,822 patent, the loop is advantageously located above the piston at all stages of dispensing the material 22, which effectively keeps the material above the piston to prevent trapping material within the container.

Figure 4:
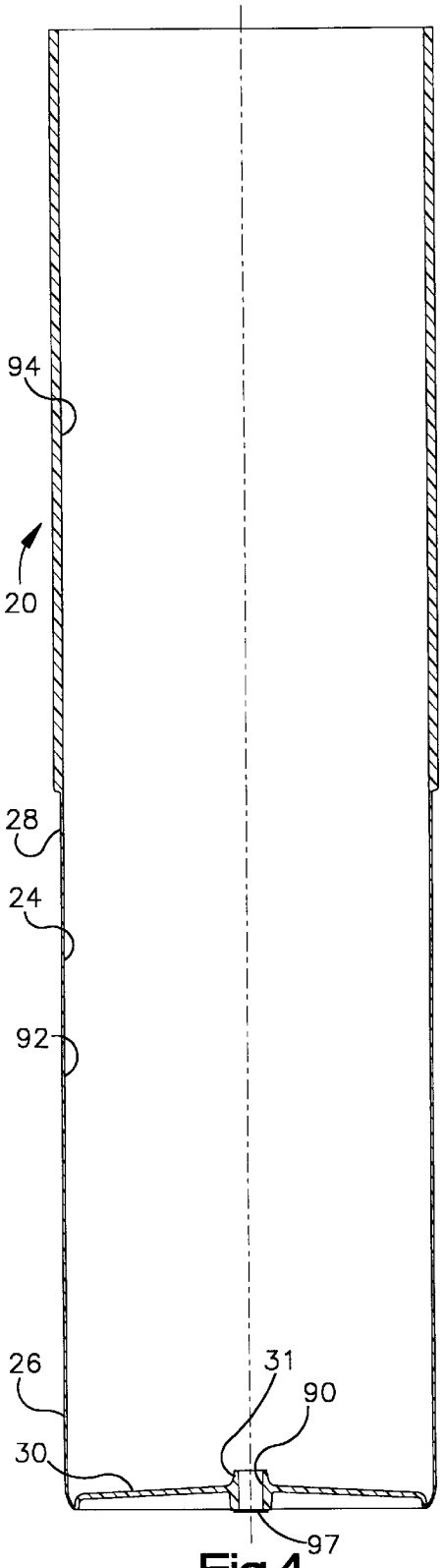
FIG. 4 is a longitudinal sectional view of an unfilled cartridge of the present invention.
Figure 5:
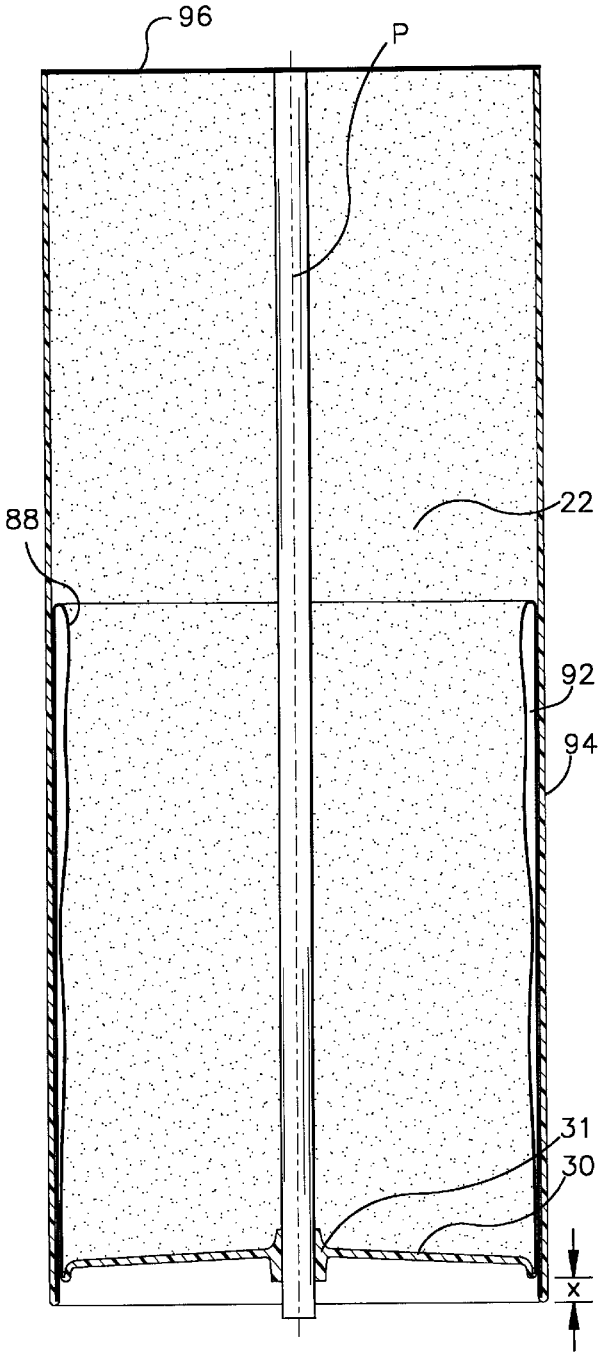
FIG. 5 is a longitudinal sectional view of a filled and sealed cartridge of the present invention.

The cartridge is an advantageous feature of the present invention and enables the same container to be used repeatedly by simply replacing a spent or depleted cartridge with a refill cartridge. As shown in FIGS. 4 and 5, the cartridge includes an expansible bladder having the first end portion 26 and the second end portion 28 spaced apart from the first end portion. The collar portion 31 of the piston has a central aperture 90 that is configured for receiving the support post P. The piston is connected to the first end portion of the bladder so that virtually no air can pass from the interior or bottom portion of the bladder, externally of the bladder such as when the rod is received by the collar aperture 90. The cartridge preferably carries the post as shown in FIG. 5. A lower section 92 of the cartridge is pushed into an upper section 94 of the cartridge to form the loop 88 in the cartridge. The cartridge is filled with the fluid material 22 and then a seal 96 is fastened to the upper section of the cartridge to prevent discharge of the fluid material from the cartridge.

To provide the cartridge with more rigidity to facilitate shipping and handling or loading of the cartridge into the container, the upper section 94 of the cartridge may be formed of a less flexible, preferably thicker material than the lower section 92 of the cartridge. In this case, the lower section 92 functions as the bladder while the upper section 94 functions as a casing for the bladder. For example, the upper section 94 may be formed of a plastic material about 4 mils in thickness while the lower section 92 of the cartridge may be formed of a plastic material about 2 mils in thickness. The upper and lower sections of the cartridge are preferably formed of the same material. However, the lower section of the cartridge may be formed of a different material than the upper section. The lower section may be integrally formed with the upper section, or formed separately and heat sealed or otherwise connected to the upper section.

Alternatively, the upper and lower sections 94, 92 of the cartridge may be formed of material having the same thickness. In this case, the lower section 92 having a length similar to the length of the thinner material section 92 shown in FIG. 4, functions as the bladder while the upper section 94 of the same thickness material receives the lower section. Although a cartridge having the upper and lower sections formed of the same thickness material may be less rigid than the two thickness cartridge shown in FIG. 4, it may have sufficient rigidity for shipping and handling. In this regard, the cartridge material may be thin enough to enable formation of the loop and to be expanded by the displacement fluid, yet thick enough to provide the cartridge with sufficient rigidity.

The cartridge may be formed without the support post as shown in FIG. 4. In this case, there would be a seal 97 on the opening 90 in the collar of the piston to prevent the fluid material from escaping, in addition to the seal 96. In this regard, the piston may be mounted to the upper portion of the container in the manner described in the U.S. Pat. No. 5,687,882 patent. The seal of the cartridge would be broken from above by the post or in another manner and the cartridge would be inserted into the container while aligning the post with the opening 90 in the piston and a central opening 98 in the end cap 32.

The support post may also be positioned in the cartridge in other ways which would be apparent to those skilled in the art in view of this disclosure. For example, the cartridge may be fabricated as in FIG. 4 without a support post and with the seal 97 of the aperture 90 and the seal 96 at the dispensing end of the cartridge. The post may then be received in the recess 98 of the support cap. The cartridge may be loaded into the container and the seal 96 punctured by the cutting elements. The seal 96 may also be punctured by moving the post upwardly into the sealed cartridge before or after it has been loaded into the container. The seal 97 of the collar aperture 90 may be punctured by inserting the post through it or in some other fashion. The post is inserted all the way into the container by moving the end cap that carries the post, toward the dispensing end. The cartridge is sealed in the container by threading the end cap in place onto the container. The post may be removably inserted into the recess of the end cap, integrally formed with the end cap, or otherwise supported in the container.

In a preferred embodiment, the cartridge is fabricated, for example, in the form shown in FIG. 4. The support post P is received by the opening 90 in the collar of the piston. The lower section 92 is moved into the upper section 94 forming the loop 88 as shown in FIG. 5. The fluid material 22 is filled into the cartridge which is then covered by the seal 96, fastened in a manner known to those skilled in the art. Cutting the seal 96 after the cartridge is inserted into the container is advantageous in that it reduces or eliminates contact of air or other displacement fluid outside the container with the fluid material inside the container.

When the container is in need of a refill, the end cap is removed from the container and the spent cartridge is moved out of the container. At this point during the refill, or in the case of loading a cartridge for the first time, the refill cartridge has its seal broken or unbroken and is oriented so that the piston is at the distal end of the cartridge relative to the container. The proximal end of the cartridge is then moved into the container toward the dispensing end portion. To break the seal of the cartridge, the container may include the cutting elements 100 formed integrally with the container or otherwise fastened to it. The cartridge is preferably inserted until its proximal end reaches the portion at which the side wall of the container begins to taper inwardly at 102. At this point, the cutting elements 100 break into the seal 96. By twisting the cartridge, the cutting elements may cut a partial or complete opening into the seal. It is not believed that the material of the partially cut seal will impair discharge of material from the container. Therefore, cutting the seal partially may be preferable to cutting the seal completely to avoid having to remove the cut seal portion from the discharged fluid material.

Once the cartridge is fully loaded into the container and the seal is cut, the end cap 32 is preferably fastened to the container. As discussed above, other variations of the refill procedure may be used such as first loading the cartridge and then inserting the post through the collar aperture 90 by moving the end cap which supports the post, toward the dispensing end portion of the container.

As seen in FIG. 3, the container preferably includes exterior threads 104 at the end portion 16. Corresponding to these threads are interior threads 106 formed in the end cap 32. The end cap may be fastened to the container in other ways which would be apparent to those skilled in the art in view of this disclosure such as by a snap fit. As the end cap is threaded onto or otherwise fastened to the container, a taper 108 around the opening 98 of the end cap locates the post into the opening 98. The advancement of the end cap toward the dispensing end portion forces the end post against a stop member 110 supported in the container. This in turn forces the post into the opening 98 in the end cap preventing further movement of the post within the container. The end cap thus seals the container at the displacement fluid end portion.

Figure 7:
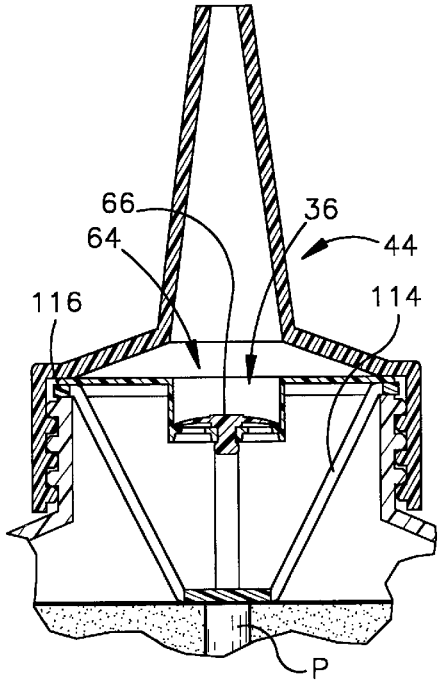
FIG. 7 is a partial sectional view showing one aspect of a stop member constructed in accordance with the present invention.

The stop member may be received in a shoulder 112 formed near the neck portion of the container. The stop member may be snap fit, adhered, heat sealed, or otherwise fastened to the container, preferably onto the shoulder 112. Alternatively, stop member 114 (FIG. 7) may be fastened in the container by a portion 116 which is disposed between the upper cap and the top of the neck portion.

Figure 8:
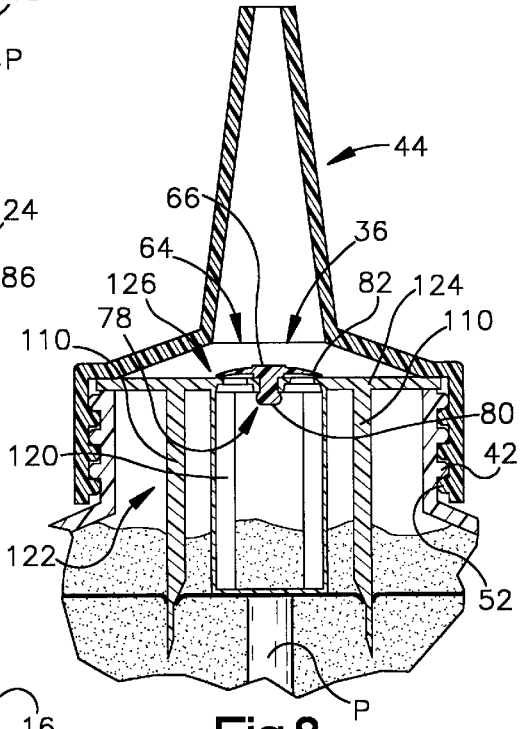
FIG. 8 is a partial sectional view showing another aspect of a stop member constructed in accordance with the present invention.

Another configuration of stop member is designated 120 in FIG. 8, which extends from a multipurpose insert 122 comprising a base portion 124. The base portion forms a valve seat 126 at a central location, in which is disposed the second passageway 64 having the hub portion 78, the valve opening 80, and the openings 82. Extending from the base portion 124 are the cutting elements 100. The insert 122 may be secured at the end of the threads 52 in the cap 44, and the cap may then be threaded onto the threads 42 on the neck. Other configurations of stop members and ways of fastening the stop member in the container would be apparent to those skilled in the art in view of this disclosure.

When the cartridge is filled with the fluid material as shown in FIG. 5, the upper cartridge section 94 extends beyond the piston 30 by a distance X. As shown in FIG. 3, this enables the upper cartridge section 94 to be trapped between a tapered wall 118 of the end cap 32 and the inside surface of the side wall 18 of the container. This provides an air tight seal of the cartridge inside the container. Other angles of the tapered wall may be employed so as to suitably trap and even deform the cartridge against the container side wall to provide an airtight seal of the cartridge in the container.

Rather than employing the tapered surface 118 of the cap, other constructions of the cartridge, cap and/or container may be used to provide an air tight seal of the cartridge in the container. For example, the cartridge may be formed with a flange F at the bottom of the section 94 shown by dotted lines in FIG. 3, which may be trapped against the bottom edge of the container by the end cap.

FIG. 2 shows the container 12 being squeezed in the direction of arrows A on the dispensing material section above the piston. Upon squeezing the container, the second check valve 66 opens in response to a high internal pressure within the container overcoming the bias of the second check valve to permit dispensing of material C through the cap opening 50. In the meantime, the first check valve 56 remains closed so the volume of the bladder 24 will not diminish.

When the container is released, the side wall begins to move in a direction to assume its original shape. This reduces internal pressure and the second check valve 66 closes, preventing foreign material from entering the container through the second passageway 64. The first check valve 56 also opens in response to the reduced internal pressure within the container, which is lower than ambient pressure outside the container 16. The outside pressure overcomes the bias of the first check valve 56, and displacement fluid such as air flows into the container through the first passageway 54. This air acts on the bladder and piston to inflate the bladder as shown in FIG. 2, and to retain or to move the piston in or to an advanced position directly against the fluid material. As a result of a "squeegee" effect of the inflated bladder against the cartridge side wall, trapping portions of material below the piston or between the bladder and the side wall is avoided.

When the container is full of the material, and squeezed above the piston, the fluid is directly dispensed because downward movement or advancement of the piston is prohibited by the displacement fluid in the bladder. The piston will then be forced upward by the upward flow and ambient pressure of the displacement fluid that flows into the bladder due to the decreased internal pressure resulting from the return of the side wall to its original shape. Thus, pressure in the loop and beneath the piston constantly lifts or advances the piston throughout dispensing. When the loop of the bladder begins to be filled by the displacement fluid, the bladder will expand above the piston until it balloons inward from the side wall. When the container is significantly empty and squeezed below the piston, the piston will be forced upward toward the dispensing end to discharge contents and then will be maintained there by the displacement fluid that enters the bladder when the side wall returns to its original shape.

Internal pressure within the container presses a portion of the bladder forming the loop (i.e., the portion of the bladder shown closest to the side wall) against the inside of the cartridge sidewall to prevent material from being present between the inside of the cartridge sidewall and the bladder. This pressing action of the bladder against the inside of the sidewall or "squeegee" effect occurs throughout the dispensing of material, since the filled loop is present throughout dispensing. The pressing action of the bladder against the sidewall inhibits downward flow of material therebetween, and thus the loop of the bladder and the piston form a pouch that contains the material above the piston.

The container may also include a member that limits the degree of flexure to which the sidewall can be subjected, as disclosed in U.S. Pat. No. 3,319,837, which is incorporated herein by reference. In this way, only a uniform, predetermined volume of the material is dispensed.

The piston may be formed with the collar 31 for providing a friction fit between the piston and the rod. This friction fit resists movement of the piston along the rod toward the cap. The support post may be cylindrical, square or some other shape. The bladder may be connected to the skirt of the piston. To describe the frictional effect of the collar on the post, when the container is squeezed, for example, in the directions of arrows A as in the first embodiment, the second check valve opens in response to a high internal pressure in the container overcoming the bias of the second check valve to allow flow of the material through the cap out of the opening. The frictional engagement of the collar of the piston along the rod resists upward movement of the piston. When the container is released and begins to assume its original shape, the second check valve closes to prevent foreign material from entering the container, and the first check valve opens in response to the internal pressure of the container being less than the pressure outside of the container which overcomes the bias of the first check valve. The frictional engagement between the collar of the piston and the rod, which resists the upward movement of the piston, assures that displacement fluid flows past the piston about its periphery to inflate the bladder above the piston. Once the loop of the bladder has been fully inflated, the forces on the bladder and the piston overcome the frictional resistance between the rod and collar and move or advance the piston toward the dispensing end of the container. As described with respect to the first embodiment, the inflated loop, which presses against the side wall, as well as the piston, act to maintain the material above the bladder and the piston.

Figure 6:
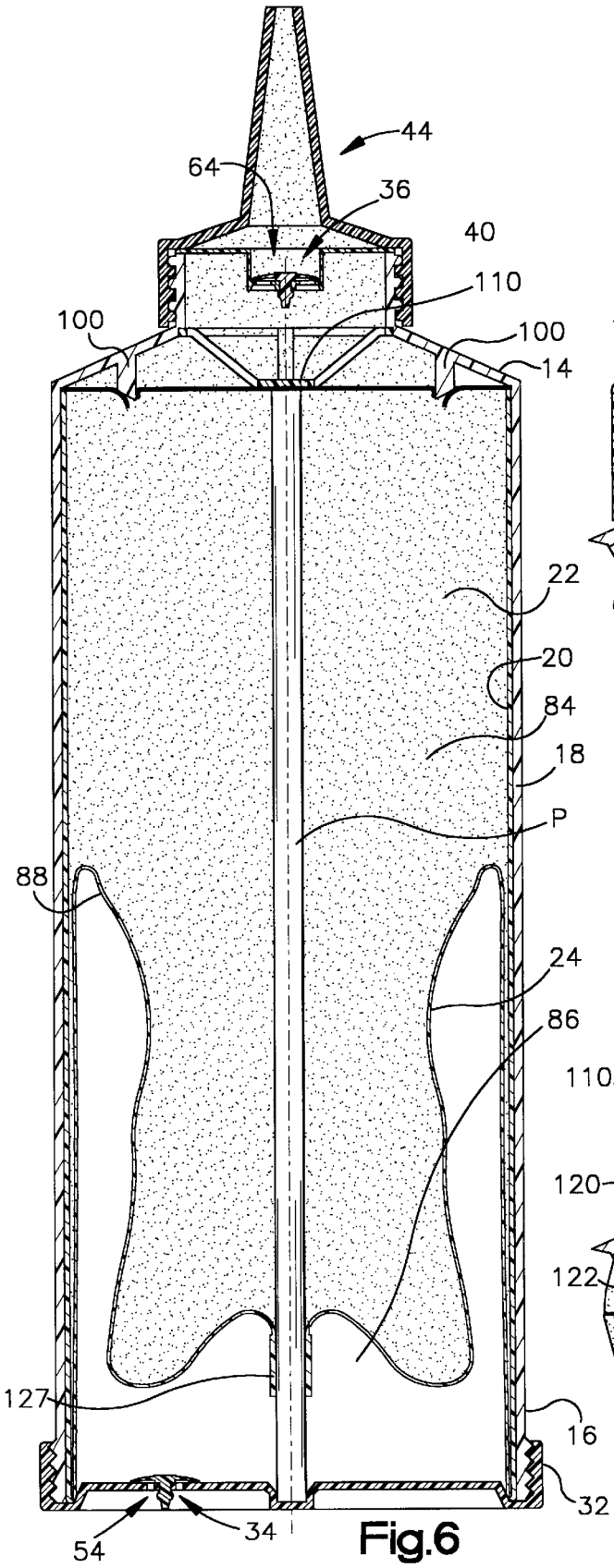
FIG. 6 is a longitudinal sectional view of another embodiment of a dispenser constructed in accordance with the present invention.

In another embodiment, shown in FIG. 6, where like reference numerals designate like parts, instead of the piston shown in FIG. 1, the dispenser includes a collar member 127 having an inner surface portion that frictionally engages the rod. This frictional engagement resists movement of the collar on the rod and assures that the loop of the bladder is located above the collar to prevent necking of the bladder that could trap material in the container. The loop acts in a manner similar to the first two embodiments and exhibits a similar "squeegee" effect against the sidewall.

In operation, when the container in the embodiment of FIG. 6 is flexed, the second check valve opens in response to a high internal pressure within the container overcoming the bias of the second check valve, and fluid material is dispensed from the container through the second passageway. Upon releasing the container so that it assumes its original shape, the second check valve closes to prevent foreign material from entering the container, and the first check valve opens in response to an internal pressure within the container being lower than the pressure outside the container which overcomes the bias of the first check valve. Displacement fluid such as air then enters the container through the first passageway and acts upon the loop of the bladder to maintain the loop above the collar. When the loop is fully expanded above the collar, the pressure of the displacement fluid overcomes the frictional resistance between the collar and the rod, causing the collar to advance up the rod toward the dispensing end.

In this embodiment, although a piston is not used, the inflated loop of the bladder will inhibit material from entering between the bladder and the cartridge side wall. However, the frictional engagement between the collar and the rod may be varied selectively along the rod in this and in the other embodiments. For example, by allowing the collar to slide relatively easily along the rod until it approaches the upper end of the rod, the bladder can expand upwardly without initially pressing against the side wall.

By using variations in the diameter or surface finish of the rod, the collar, or the piston in this or in other embodiments, the amount of frictional engagement, and hence the ease of movement of the collar or the piston on the rod, may be adjusted as desired.

The container and cartridge may take on geometric configurations having symmetrical upper and lower portions other than cylindrical, such as an hour glass shape, with a comparably shaped bladder, and can include a collar and rod to control expansion of the bladder. The rod and collar must of course fit through the waist of the hourglass shape. In addition, the bladder need not have a size and shape to fill the container when it is empty, but may assume a variety of colors, shapes, and sizes. If the container is formed of transparent plastic, and the bladder is visible from outside the container, it can be in the form of a number of attractive shapes. For example, the bladder could be in the shape of a clown or the like. The container may thus serve the dual purposes of dispensing material and entertaining children. Of course, some material will remain in the container if the bladder does not entirely fill the container due to a difference in shape.

As another novelty item, the dispenser may contain air as the fluid material. The bladder may be in the shape of an object or figure for entertaining children such as a face. The child may cause the bladder to inflate by squeezing the container, thereby forming the bladder into the novelty object in the container. A variation of this is to have the bladder made of a stretchable material such as a balloon. The bladder may be deflated by removing the cap 44 and depressing the piston toward the displacement fluid end portion while moving the first check valve 56 up to enable the displacement fluid to leave the container. The toy may include a variety of refill cartridges each having a different object or figure.

Rather than using the cap having only an opening to dispense the fluid material, since the container is always "full" of material until empty, i.e., gravity feed is not required, any number of applicators including rollers, sponges, brushes, atomizers, and the like may be used in conjunction with or in place of the cap, such as those disclosed in U.S. Pat. No. 3,319,837, which is incorporated herein by reference.

Figure 9:
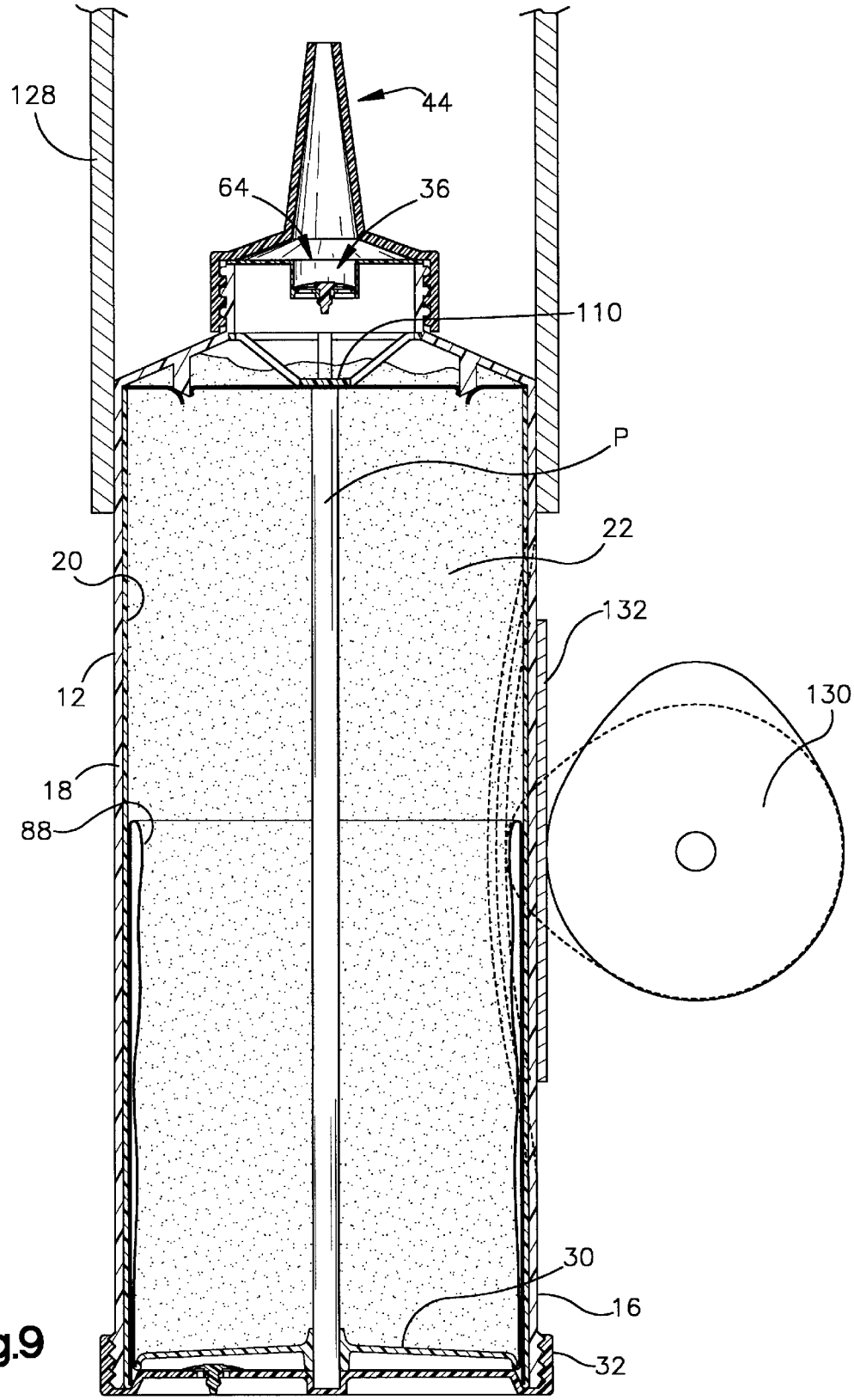
FIG. 9 is a longitudinal sectional view showing a dispensing operation in accordance with the present invention using a cam.

As seen in FIG. 9, the present invention lends itself to an industrial dispensing system in which the container is mounted to a support 128 such as a clamp and the container wall is pressed inward by mechanical means, such as a rotary cam 130 to dispense the fluid material upon rotation of the cam as shown by dotted lines. The cam may act upon a flexible pressure plate 132. Because the force applied to the container wall by the cam, or the other mechanical, pneumatic or hydraulic operator, can be great, a relatively stiff and/or thick container wall can be used and a highly viscous material can be dispensed, the stiffer container wall providing the necessary force to expand the wall back to its original shape after the dispensing force is removed. The cartridge 20 provides a convenient way to refill the container, which can remain mounted in the support.

Figure 10:
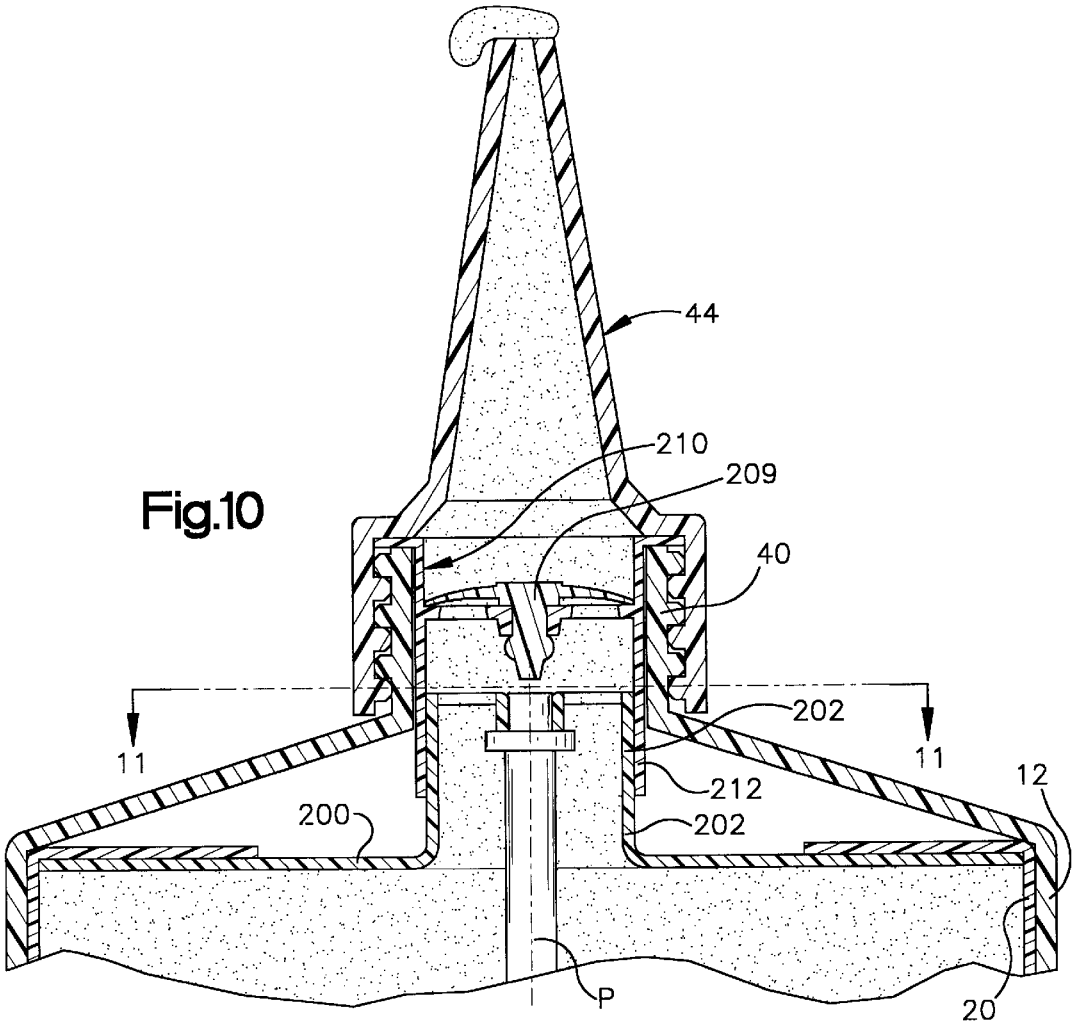
FIG. 10 is a partial view in section of another embodiment of the invention.
Figure 11:
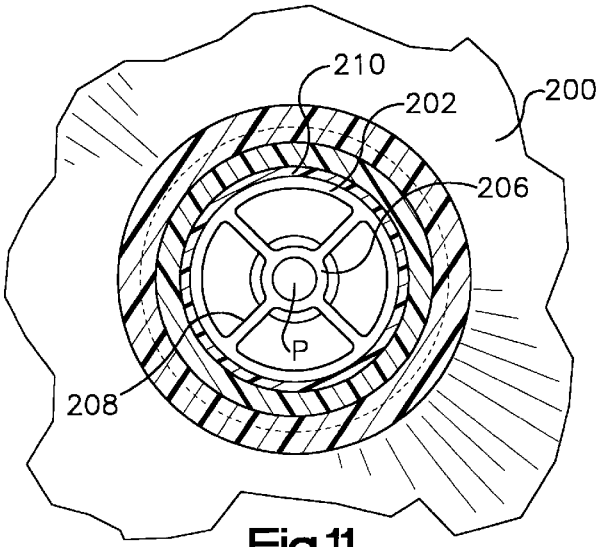
FIG. 11 is a view partly in plan and partly in section, as viewed from the line 11—11 of FIG. 10.
Figure 12:
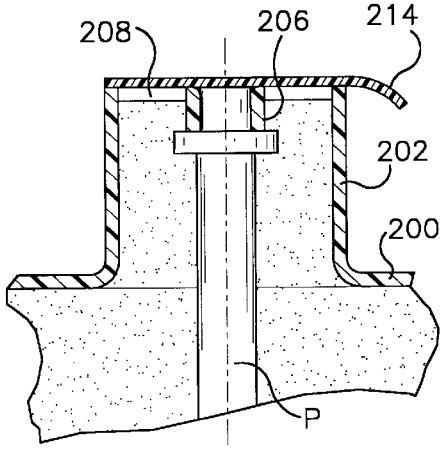
FIG. 12 is a sectional view of the cartridge top shown in FIG. 11.

An alternative embodiment of the invention utilizes additional structure to inhibit the contents of a cartridge from entering the container when dispensed, and instead be channeled directly to the cap 44. This avoids the need to clean the container between cartridge changes. As shown in FIGS. 10–12, the cartridge 20 has a top 200 that is rigid enough to maintain its form and support the post or rod P. The top is sealed to the cartridge wall. A central boss 202 extends from a disc portion 204 of the top and forms a conduit that terminates in a central hub 206 supported by spokes 208 extending radially from the boss. A central aperture in the hub receives and supports the post P within the cartridge. The lower end of the post is inserted into the base of the container, as shown in FIG. 3, after the cartridge is inserted into the container. A flow restrictor, such as a check valve 209 or constrictive aperature is supported by a member 210 analogous to the valve seat body 68 shown in FIG. 3, but which includes a tubular skirt portion 212 that extends in the direction of the cartridge and receives and closely surrounds the boss 202. The member 210 is located within the neck portion 40 of the container 12, secured by the cap 44. The cartridge has a cover closing the boss. For example, a peal-off seal 214, which protects the contents and prevents leakage until the cartridge is to be inserted into the container. When contents of the cartridge is dispensed, it flows through the boss, between the spokes and through the flow restrictor 209. That flow is contained in a conduit formed by the boss and the member 210 until it reaches the cap 44. With this arrangement, slightly different neck diameters can be accommodated by the member 210 without changing the cartridge top to a different boss diameter. However, as an alterative, it will be understood that the boss could be of sufficient length to extend entirely through the neck portion 40 and in close fit to the interior wall of the neck portion, and could contain or terminate in a flow restrictor, thereby taking the place of the member 210, while still channeling flow in a manner to restrict the dispensed material from the interior of the container.

Figure 13:
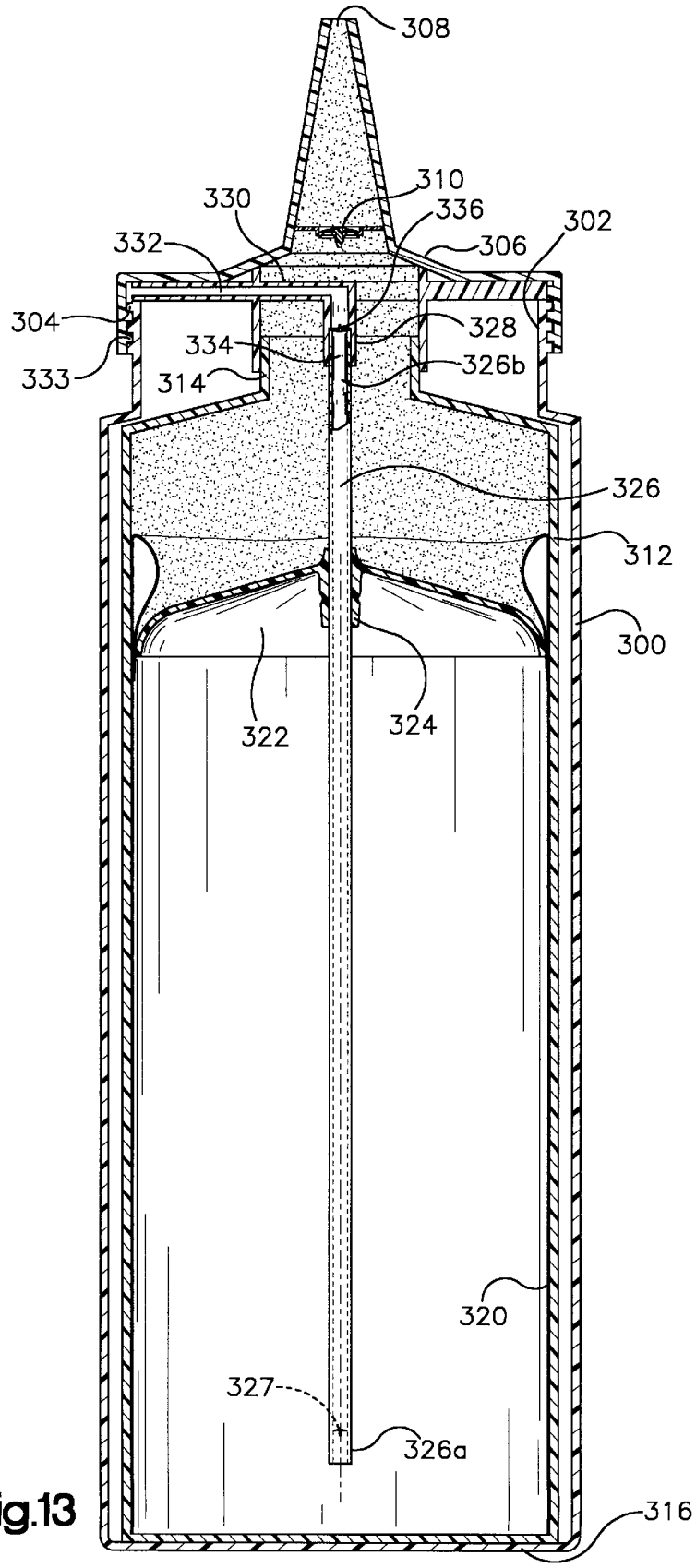
FIG. 13 is a sectional view of a container and cartridge illustrating a further embodiment of the invention.

A further embodiment of the invention is shown in FIG. 13, in which a container 300 has only one open end 302, with threads 304 to receive a cap 306 having a discharge opening 308 and a check valve 310 or other restriction permitting discharge of fluid from the container while preventing entry of fluid. The open end is of sufficient diameter to receive a cartridge 312. The cartridge has a reduced diameter outlet 314 at a discharge end. The outlet is of tublar construction similar to that shown in FIG. 10, but without a hub and spokes. The cartridge is closed at the bottom 316, where a flexible expansible bladder 320 is connected in sealed relationship and also connected to a piston 322 that has a collar 324 that surrounds a tubular rod 326 in the same manner as the previously described pistons cooperate with a support post. The rod opens at its lower end 326*a* into the bladder and also opens through an aperture 327 in the wall of the tube, the aperture being located below the piston 322 when the piston is in the lowest position adjacent the bottom of the cartridge. The upper end 326*b* is received in the hub 328 of a disc 330 that is in the form of a ring that extends over the open end of the container, the periphery of the disc being clamped against the open end 302 by the cap. The hub is supported in the center of the ring by radial spokes 330, in a manner substantially as disclosed in greater detail in U.S. Pat. No. 5,687, 882, the disclosure of which is hereby incorporated herein by reference. A through passage 332 extends through one of the spokes 330 and radially through the surrounding ring, opening into a gap between the cap and container end, and communicating to the helical passage 333 formed between threads of the container and cap. The passage 332 also communicates to a passage 334 in the hub and into which the rod end 326*a* is received. A check valve 336 or other restriction that prevents fluid from leaving the bladder while allowing fluid to enter through the passage is located in the passage 334. A tublar skirt 338 extends from the disc 330 of a diameter to closely encircle the tubular discharge end 34, in a manner similar to that described in connection with the embodiment of FIG. 10, and for the same purpose. The bladder 320 is shown with a lower end sealed to the cartridge. Alternatively, the bladder can be a bag so it is closed at the bottom end, which then extends across the bottom of the cartridge, eliminating the need for a seal. The operation of this embodiment is the same as the others disclosed, with the exception that the displacement fluid enters through the same end of the container as the displaced fluid is dispensed and flows through the rod on which the piston slides. As a result, a conventional container having a single open threaded end can be utilized in practicing the invention. It is contemplated that other structures can be provided to form a passage that allows entry of displaced fluid through the single opening of a container, for example, by directing the passage 332 to an opening in the cap.

It will be appreciated that the invention is an exchanger of fluids; i.e., the fluid of the cartridge is exchanged for the ambient displacement fluid. While a primary purpose is to enhance the ability to expell the contents of the cartridge and to maintain the contents isolated from the ambient atmosphere, the intent of the use can be to collect fluid from the surroundings and store it in the expansible bladder. For example, if it is desired to retrieve fluids that have spilled, an empty (except for air) cartridge can be inserted into the container, the base of the container of the type in which the displacement fluid enters through the bottom can be immersed in the spilled fluid, and as the air is expelled by squeezing and releasing the container, the fluid will enter the bladder to displace the expelled air. The inlet at the base of the container can be modified to enhance the ability to extract fluid from particular environments and specific purposes; e.g., a hollow needle, a flexible tube or other gathering device could be connected to the inlet. A chemical could be contained in the bladder to indicate a characteristic or condition of the ambient fluid.

While preferred embodiments have been described in detail, various modifications or alterations can be made therein without departing from the spirit and scope of the invention set forth in the appended claims.

What is claimed is:

1. A refillable dispenser of fluid material, comprising a flexible container having a fluid dispensing portion and a displacement fluid receiving portion, a cap removably fastened to said container for closing an opening at said displacement fluid receiving portion, a cartridge disposed in said container and containing fluid material to be dispensed, said cartridge including an expansible bladder and a collar member connecting to said bladder, a support post supported in said container and received by said collar member, first flow restricting means for allowing flow of fluid only from outside the container into an interior of said bladder, and second flow restricting means for allowing flow of material only from within an interior portion of the container external to said bladder to outside the container.

2. A dispenser according to claim 1 wherein said first flow restricting means comprises a first passageway into the container communicating with the interior of said bladder, and a first check valve cooperating with said first passageway.

3. A dispenser according to claim 1 wherein said second flow restricting means comprises a second passageway into the container and communicating with an interior portion of the container external to said bladder, and a second check valve cooperating with said second passageway.

4. A dispenser according to claim 3 wherein said cartridge has an end with a formed outlet, and the second flow restricting means is located in said fluid dispensing end portion of the flexible container, in part closely surrounds the outlet of said cartridge end, and forms a conduit between the cartridge outlet and the container outlet.

5. A dispenser according to claim 1 wherein said collar frictionally engages said support post.

6. A dispenser according to claim 1 comprising a piston adapted for movement in the container, said piston extending from said collar member.

7. A dispenser according to claim 6 wherein said piston is formed of flexible material.

8. A dispenser according to claim 1 wherein said support post is carried by said cartridge.

9. A dispenser according to claim 1 wherein said cap includes a recess for receiving said support post.

10. A dispenser according to claim 1 wherein said cap includes said first flow restricting means.

11. A dispenser according to claim 1 wherein said container is exteriorly threaded near said displacement fluid receiving portion and said cap is interiorly threaded for engaging the thread of said container.

12. A dispenser according to claim 1 wherein said cartridge includes a first section formed of material of a first flexibility and a second section formed of material of a second flexibility, said first flexibility being less than said second flexibility.

13. A dispenser according to claim 12 wherein said first section has a greater thickness than said second section.

14. A dispenser according to claim 1 including means for opening said cartridge.

15. A dispenser according to claim 1 comprising a stop member supported in said container at a position that prevents movement of said support post toward said fluid dispensing end portion.

16. A cartridge receivable in a dispenser of fluid material that has flow restricting means at an outlet and at an inlet, said cartridge comprising:

a body portion having a wall that forms a fluid dispensing opening and an enclosure that contains fluid material;

an expansible bladder extending from said body portion, said bladder being configured and arranged to be received inside of said body portion such that an interior surface of said bladder forms a portion of said enclosure;

a collar member connected to said bladder and constructed to slideably receive a post; and a seal that covers said fluid dispensing opening for preventing said fluid material from being discharged from said body portion.

17. A cartridge according to claim 16 comprising a support post received in an aperture of said collar member.

18. A cartridge according to claim 7 wherein said wall includes a conduit surrounding the fluid dispensing opening and a support for receiving said post.

19. A cartridge according to claim 18 wherein said conduit includes means to restrict the flow of fluid from the dispensing opening.

20. A cartridge according to claim 19 wherein said means includes a removable cover for preventing flow from the fluid dispensing opening.

21. A cartridge according to claim 16 wherein said body portion is formed of material of a first flexibility and said bladder is formed of material of a second flexibility, said first flexibility being less than said second flexibility.

22. A cartridge according to claim 21 wherein said body portion has a greater thickness than said bladder.

23. A cartridge for a dispenser of fluid material, said cartridge comprising:

a body portion having a wall that forms a fluid dispensing opening and an enclosure that contains fluid material;

an expansible bladder extending from said body portion, said bladder being configured and arranged to be received inside of said body portion such that an interior surface of said bladder forms a portion of said enclosure;

a collar member connected to said bladder;

a piston adapted for movement in the container, said piston extending from said collar member; and a seal that covers said fluid dispensing opening for preventing said fluid material from being discharged from said body portion.

24. A cartridge according to claim 23 wherein said piston is formed of flexible material.

25. A cartridge for a dispenser of fluid material, said cartridge comprising:

a body portion having a wall that forms a fluid dispensing opening and an enclosure that contains fluid material;

an expansible bladder extending from said body portion, said bladder being configured and arranged to be received inside of said body portion such that an interior surface of said bladder forms a portion of said enclosure;

a collar member connected to said bladder;

a piston connected to said bladder, said piston including said collar; and a seal that covers said fluid dispensing opening for preventing said fluid material from being discharged from said body portion.

26. A cartridge according to claim 25 wherein said bladder is folded into said body portion so as to form a loop inside said body portion.

27. A refillable dispenser of fluid material, comprising a flexible container having a fluid dispensing portion and a displacement fluid receiving portion spaced from said fluid dispensing portion, a cap removably fastened to said container for closing an opening at said displacement fluid receiving portion, a cartridge disposed in said container and containing fluid material to be dispensed, said cartridge including an expansible bladder separating said portions, first flow restricting means for allowing flow of fluid only from outside the container into the displacement fluid receiving portion, and second flow restricting means for allowing flow of material only from within an interior portion of the container external to said bladder to outside the container.

28. A dispenser according to claim 27 comprising a piston connected to said bladder.

29. A dispenser according to claim 27 comprising a collar member connected to said bladder and a support post supported in said container and received by said collar member.

30. A refillable dispenser of fluid material, comprising a flexible container having an end for fluid dispensing and for receiving displacement fluid, an end cap removably fastened to said end of the container a cartridge disposed in said container and containing fluid material to be dispensed, said cartridge including an expansible bladder and a collar member connected to said bladder, a tubular support post supported in said container received by said collar member, and opening at or adjacent one end into the bladder and communicating through said end of the container to a source of displacement fluid, first flow restricting means for allowing flow of fluid only from outside the container into an interior of said bladder, and second flow restricting means for allowing flow of material only from within an interior portion of the container external to said bladder to outside the container.

31. A dispenser according to claim 30 wherein the support post is supported by a member having a hub and spokes extending from a ring that is located across said end of the container, a passage through said member, communicating between the exterior of the container and the post, and wherein the first flow restricting means is located in the passage.

32. A dispenser according to claim 31 wherein said container and cap are threaded, the container end provides an opening large enough to receive the cartridge, and the passage communicates to the exterior of the container through a gap along the threads between the cap and container.

* * * * *